US009480342B2

(12) United States Patent
White

(10) Patent No.: US 9,480,342 B2
(45) Date of Patent: Nov. 1, 2016

(54) RETRACTABLE STEP STOOL/ ACCESS DEVICE

(71) Applicant: Ralph Layne White, North Little Rock, AR (US)

(72) Inventor: Ralph Layne White, North Little Rock, AR (US)

( * ) Notice: Subject to any disclaimer, the term of this patent is extended or adjusted under 35 U.S.C. 154(b) by 0 days.

(21) Appl. No.: 13/707,900

(22) Filed: Dec. 7, 2012

(65) Prior Publication Data

US 2013/0186709 A1 Jul. 25, 2013

(51) Int. Cl.

| | |
|---|---|
| ***E06C 9/06*** | (2006.01) |
| ***A47C 12/00*** | (2006.01) |
| *E06C 1/00* | (2006.01) |

(52) U.S. Cl.

CPC ..... *A47C 12/00* (2013.01); *E06C 9/06* (2013.01); *E06C 1/005* (2013.01)

(58) Field of Classification Search

CPC ..... A47B 2220/05; A47B 97/00; A47B 2200/0041; A47B 3/14; A47B 77/10; A47B 46/00; A47B 46/005; E06C 1/005; E06C 9/06; A47C 11/02; A47C 16/025; A47C 16/04; A47C 12/00; A47C 12/02; A47C 10/00; A47C 9/06; A47J 37/078

USPC ..... 182/33, 35, 33.6, 91; 4/621; 312/235.1; 248/240, 240.1, 240.2

See application file for complete search history.

(56) References Cited

U.S. PATENT DOCUMENTS

| | | | | | |
|---|---|---|---|---|---|
| 701,050 | A | * | 5/1902 | Keeran | 248/240.2 |
| 1,587,002 | A | * | 6/1926 | Jones | 182/33.5 |
| 1,596,909 | A | * | 8/1926 | Weeks | 297/112 |
| 2,599,529 | A | * | 6/1952 | Harvey | 182/97 |
| 2,682,297 | A | * | 6/1954 | Hamilton | 108/158 |
| 2,881,040 | A | * | 4/1959 | Hartridge | 312/235.1 |
| 2,900,011 | A | * | 8/1959 | Casey | 297/411.28 |
| 3,102,757 | A | * | 9/1963 | Higgins | 297/423.16 |
| 4,135,604 | A | * | 1/1979 | Ryan | 182/91 |
| 5,048,639 | A | * | 9/1991 | Scherer | 182/18 |
| 5,085,290 | A | * | 2/1992 | Guirlinger | 182/77 |
| 5,094,515 | A | * | 3/1992 | Low | 312/235.1 |
| 5,131,492 | A | * | 7/1992 | Caminiti et al. | 182/77 |
| 5,819,670 | A | * | 10/1998 | O'Connor et al. | 108/48 |
| 6,978,721 | B2 | * | 12/2005 | Myers | 108/48 |
| 8,037,557 | B2 | | 10/2011 | Sumpton et al. | |

* cited by examiner

*Primary Examiner* — Daniel Cahn

(57) ABSTRACT

The present invention is for a step stool to be used by a child, diminutive person or an adult of average height to gain vertical reach. The retractable step stool/access device is positioned by one's foot between an elevated, retracted position or a lowered, deployed step accessible position. Internal stored energy mechanisms can be employed to ease some of the physical effort required, especially by a child or diminutive person, to complete the deployment/retraction cycle with either of their feet. In the raised, retracted position, the step stool is elevated from contact with the floor and clear of the standing area for general usage and allowing access for cleaning and maintenance of the floor.

17 Claims, 5 Drawing Sheets

RETRACTABLE STEP STOOL/ ACCESS DEVICE

BACKGROUND OF THE INVENTION

1. Field of the Invention

This invention was conceived as an improvement over prior art apparatus and methods for stowable, deployable, step stools which the user can selectively position in a raised or retracted/stored position or in a lowered or extended step accessible position. Relevant prior art to this invention is found in U.S. Patent Class 182, subclass 91.

2. Description of the Related Art

Presently there are step stools of various configurations in the public domain as well as patented step stool type devices for allowing access to items, articles, and devices that are beyond vertical reach of certain persons such as children and adults of small stature and/or lesser height than the average adult. One common form of step stool is a one piece box like structure or a platform with short legs for giving a person a one step height advantage over just standing on the floor. Use is accomplished by locating the step stool in its stored location and moving and positioning it on the floor below the area to be accessed. The user then steps on the step stool thereby gaining the extra vertical reach required to retrieve an item or access a device. The user, when finished, steps off the step stool and normally moves it back to its original stored position. Such step stools are not limited to a box like structure of square or rectangular shape but can be round or oval or of odd shapes as long as a horizontal step area is provided and legs or side structure is provided that yields a stable platform on which to stand thereby gaining an extra height/reach advantage. The use and deployment of such a simple step stool normally requires the user to physically bend down and grasp the step stool with one's hands, lift it and position it in the desired location of use. Then after use again grasp the step stool, lifting it and returning it to its place of storage. A favored use of a step stool for a child is for gaining a height advantage at the bathroom lavatory for washing and grooming. This is so in the place of residence but also at public facilities. Both present a sanitation issue since after the person has washed up and stepped off the step stool and then grasps the step stool and returns it to its stored location they have again soiled their hands, but now cannot reach the sink to wash them again. This situation needs a remedy. A convenient place for storing the step stool is under the sink or in or about the sink/lavatory cabinetry. The prior art has attempted to address this situation by various means. Such means have taken the forms of steps that's hinged to a structure so that the step can be folded out into position and after use be repositioned to the stored position by folding the step back. Others seek to accomplish this by deployment and restoring by use of a sliding mechanism.

Both U.S. Pat. No. 8,037,557 to Sumpton et al (2011) and U.S. Pat. No. 5,131,492 to Caminiti (1992) show repositional steps manually actuated by the user. Both of these patents show the ability to be disposed in a stored configuration or access configuration. U.S. Pat. No. 8,037,557 to Sumpton (2011) provides a sink access device which has a top step platform pivotally attached to a base. The base is secured to the floor with the step platform able to be positioned in a vertical, stored position or a horizontal step accessible position. The Sumpton patent device is mechanically fastened to the floor beneath a sink or lavatory to provide a step platform for a child or other diminutive person to reach the sink. The Sumpton patent device is meant to be used in conjunction with a sink exclusively. The Sumpton device cannot be installed inside of any enclosure such as cabinetry and the base is mounted at floor level only. The base cannot be relocated to facilitate the cleaning of the floor and no component for storage of loose items is provided.

U.S. Pat. No. 5,131,492 to Caminiti provides a collapsible folding step-stool which is mountable to a cabinet door. The step stool has a bracket mountable to a cabinet door and a step platform. The platform may be lowered from a raised vertical stored orientation to a horizontal operative position in which the platform is supported by four legs which contact and rest upon the floor. A plurality of parallel arms pivotally couple the step platform to a U-shaped member which is in turn mounted to the cabinet door. The step platform is manually raised from a horizontal operative position to a vertical stored orientation disposed within the U-shaped channel. The pivotally coupled four legs collapse and fold to a position within the U-shaped channel secured to the cabinet door. In the Caminiti patent the platform must be repositioned manually thereby requiring the use of the hands. The device cannot be stored within an enclosure like a bathroom or kitchen cabinet and provides no storage tray for loose items. Further, the user must bend down and manually lock the step platform in the vertical stored orientation within the U-shaped channel.

In conclusion, I am aware of no easily deployable step access assembly which can be readily lowered from a stored, raised position to a lowered step accessible position without using the hands. Ideally a step access assembly for a child or small person should remain in a position horizontal to the floor while being positioned for step access. This would remove the need to position the platform manually from a vertical stored orientation to a horizontal lowered position to provide the needed gain in vertical reach required by the user without contaminating their hands. Furthermore, I am aware of no such deployable step access assembly which provides a storage tray for loose items while also facilitating ease of floor maintenance and cleaning.

BRIEF SUMMARY OF THE PRESENT INVENTION

The invention, an improved retractable step stool/access device, is made from rigid materials. The device can be lowered from a retracted, stored position to a lowered, deployed step accessible position by the user's foot. The retractable step stools upper step platform remains positioned horizontal to the floor throughout the deployment/retraction cycle. Internal stored energy mechanisms provide assistance to a user, especially small children, for ease of vertically repositioning the device to the retracted position podiatrically. Accordingly, a fundamental object of the invention is to provide a retractable Step stool to be utilized by a diminutive person to gain desired vertical reach. Another basic object is to provide a quickly deployable and retractable step stool to be utilized in several applications where extra vertical reach height is required. It is also an object to allow operation of the retractable step stool/access device by not requiring the user to manually engage the device. Further, an important object is to require operation of the device to be accomplished by use of the users feet only. Another object is to provide a storage tray for the containment of loose items while also facilitating ease of cleaning and maintenance of floored surfaces. Still further objects and advantages will become apparent from a study of the following description and the accompanying drawings.

BRIEF DESCRIPTION OF THE DRAWINGS

In the following drawings, which form a part of the specification and which are to be construed in conjunction therewith, and in which like reference numerals have been employed throughout wherever possible to indicate like parts in various views.

DESCRIPTION OF THE INVENTION

Figure 1:
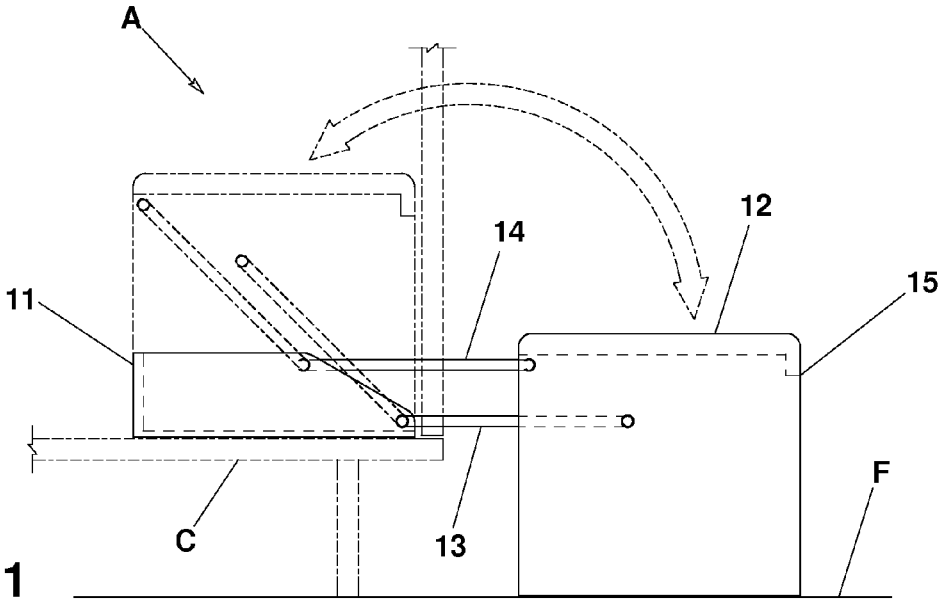
FIG. 1 is a right side elevation view of version 1 mounted in a cabinet showing the retractable step stool/access device in a lowered deployed position.
Figure 2:
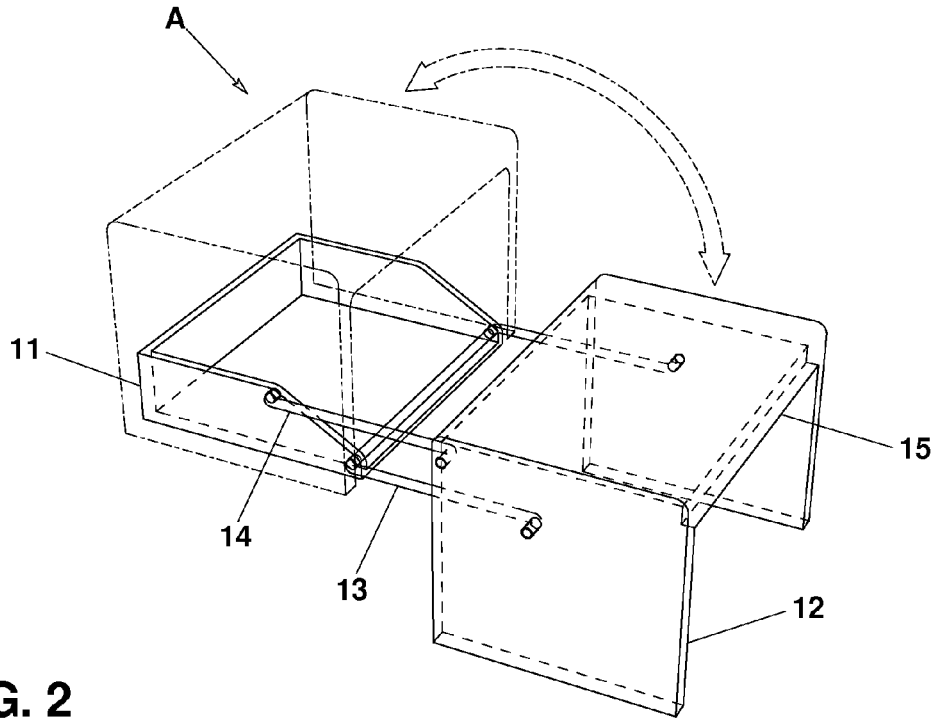
FIG. 2 is a perspective view of version 1 mounted in a cabinet showing the retractable step stool/access device in a lowered deployed position.

With reference to the drawings:

FIGS. 1 and 2 illustrate version 1 mounted within a cabinet C resting upon a floor F. The retractable step stool/access device assembly A, includes base storage tray 11 and step stool 12. Base storage tray 11 and step stool 12 are constructed of rigid material and are generally rectangular in shape. Step stool 12 has a top step platform with a down turning forward lip 15, and an open front and rear with two opposed supporting sides. Base storage tray 11 and step stool 12 are connected by means of formed rod members, lower arm 13, essentially in a U-shape, and upper arm 14, both preferably made of steel. Lower arm 13 is pivotally connected to the forward edge of base 11 with the ends of the right and left upper portions of the U-shaped arm 13 turning outward and inserting into two holes located on the interior surfaces of the opposed sides of step stool 12. The singular upper arm 14 is pivotally connected to one side of the base storage tray 11 and extends to a pivotal connection point within the interior of step stool 12.

Figure 9:
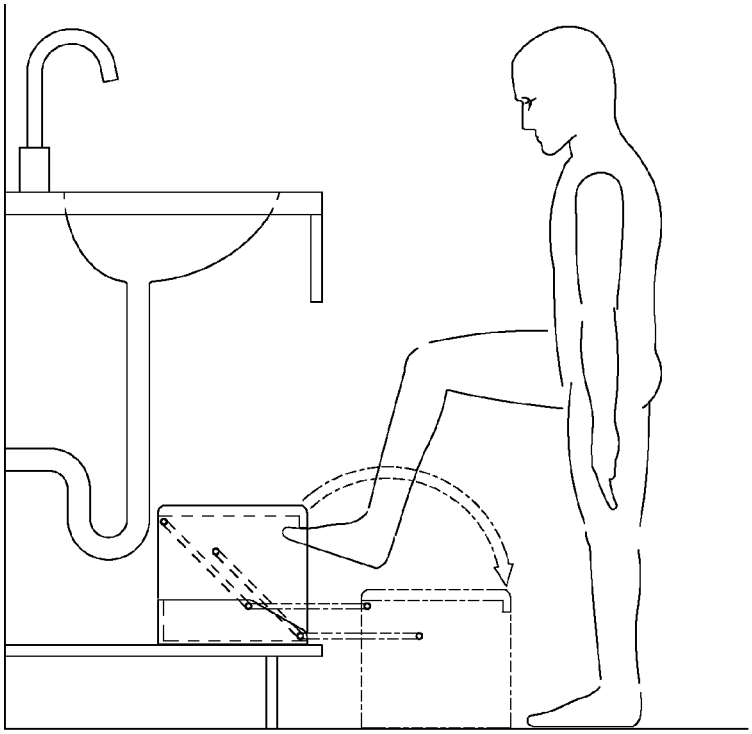
FIG. 9 is a side elevation view showing a small person deploying/re-storing version 1-2 of the step stool/access device.

As depicted in FIG. 9, a child can, by placing the toe of the foot under lip 15 lift step stool 12 from the stored position over base storage tray 11, move step stool 12 through an arc that is guided by lower arm 13 and upper arm 14 and bring step stool 12 to rest on floor F. After using step stool 12 to gain the necessary height/reach advantage, step stool 12 is returned to the stowed position over base storage tray 11 by again using the foot.

Figure 3:
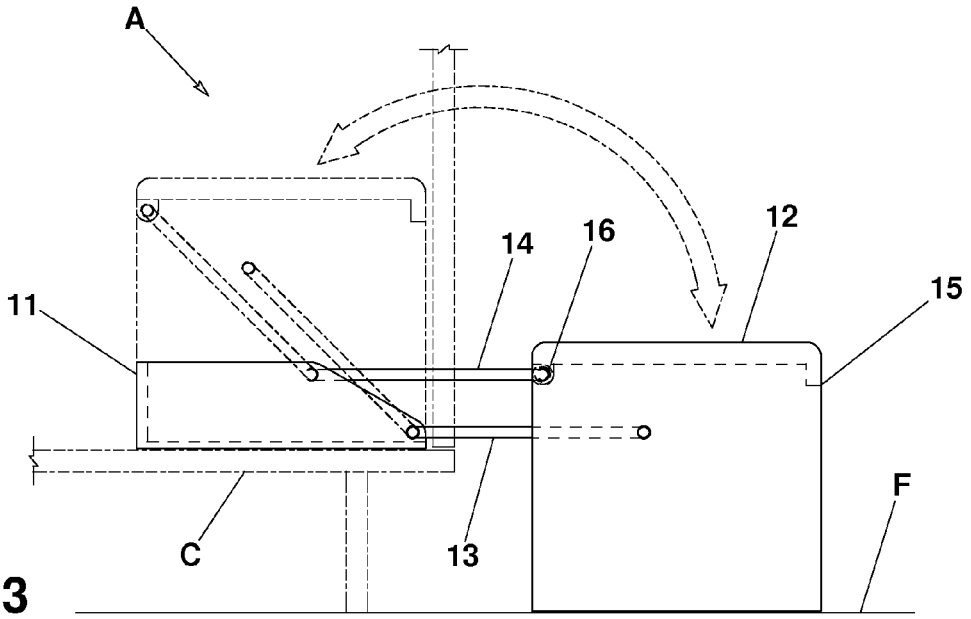
FIG. 3 is a right side elevation view of version 2 mounted in a cabinet showing the retractable step stool/access device in a lowered deployed position.
Figure 4:
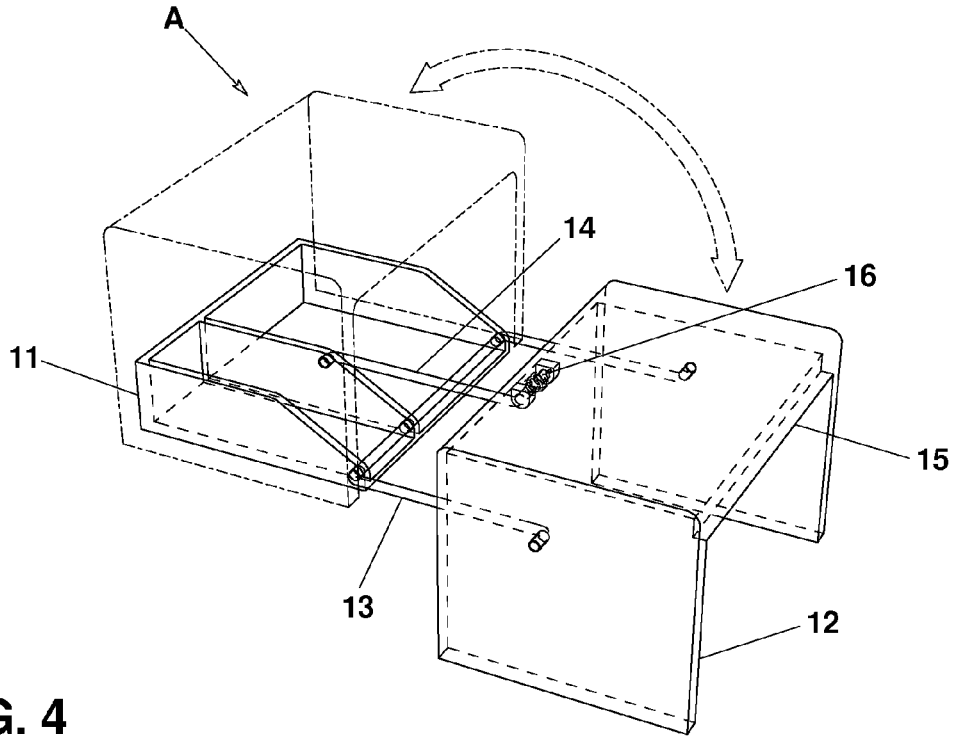
FIG. 4 is a perspective view of version 2 mounted in a cabinet showing the retractable step stool/access device in a lowered deployed position.

FIGS. 3 and 4 illustrate a second version of the invention. In this version positioning of the step stool 12 between the stored position and the deployed position is assisted by mechanical energy stored in torsion spring 16. Torsion spring 16 is attached underneath the top step surface of step stool 12, at the rearward edge, while also being pivotally connected to the upper arm 14 at one end with the other end of arm 14 being pivotally connected to a centrally located divider wall in the interior of the base storage tray 11. Deployment and retraction of step stool 12 is done with the foot in the same fashion as before but with less effort due to the assist from the energy stored in the torsion spring 16.

Figure 5:
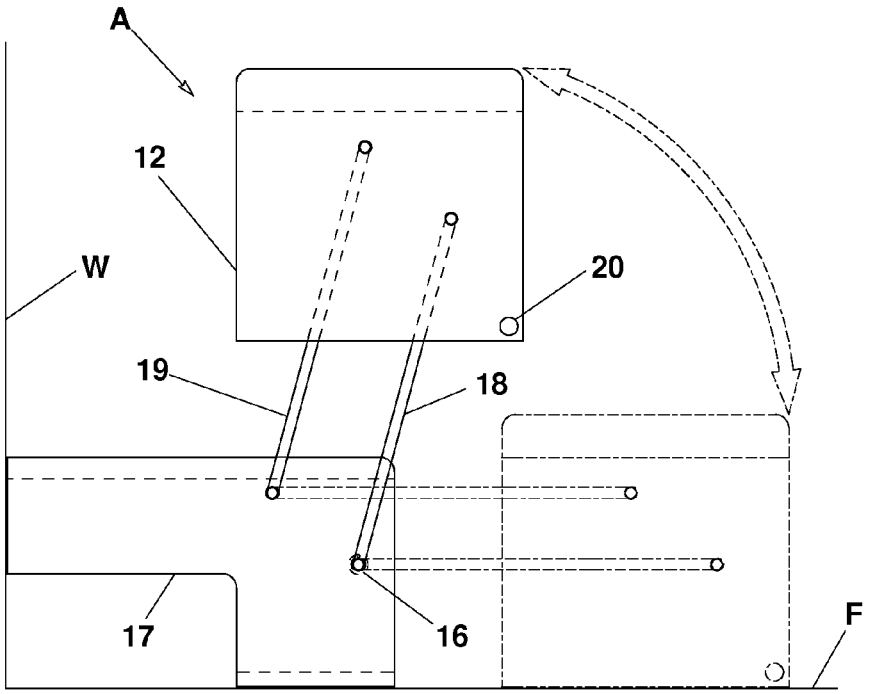
FIG. 5 is a right side elevation view of version 3 mounted to a wall showing the retractable step stool/access device in a raised stored position.
Figure 6:
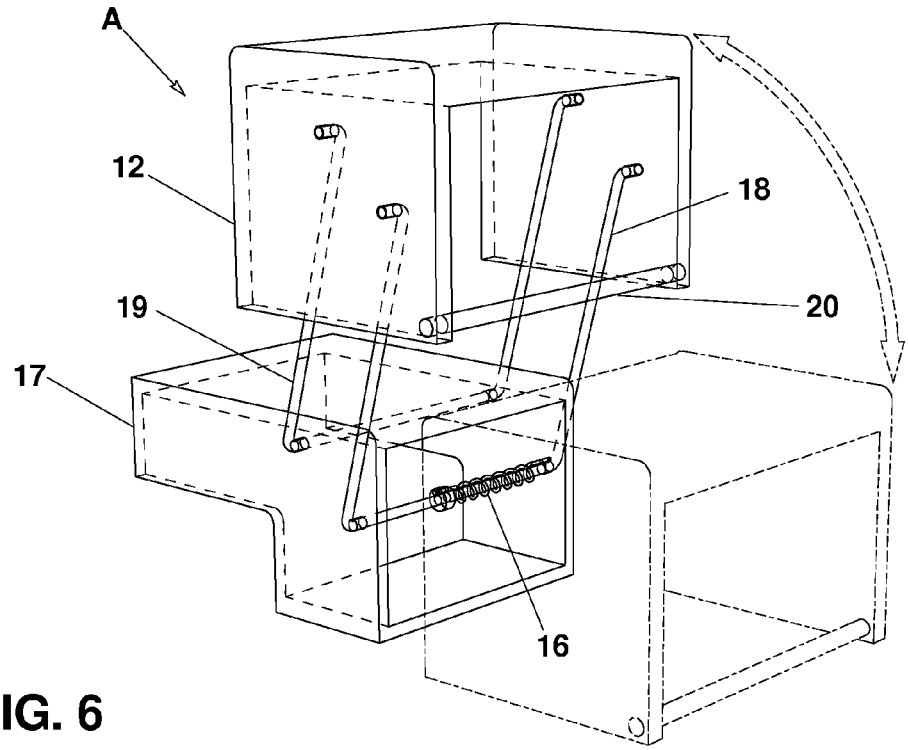
FIG. 6 is a perspective view of version 3 mounted to a wall showing the retractable step stool/access device in a raised stored position.

FIGS. 5 and 6 show a third variation of the invention. This variant of the retractable step stool/access device assembly A is generally comprised of a step stool 12 and a hybrid base 17. The hybrid base 17 can be mounted to a floor F or mounted to an upright structural wall W. Step stool 12 is pivotally coupled to hybrid base 17 by an extended U-shaped lower arm 18 and an extended U-shaped upper arm 19. The lower sections of extended arms 18 and 19 are contained within and pass through holes located in the right and left opposed sides of hybrid base 17. The upper ends of extended arms 18 and 19 turn outboard and insert into holes located in the inside surfaces of the supporting sides of step stool 12. Step stool 12 is lowered to floor F by placing a foot upon and pressing downward on foot bar 20, which is connected to step stool 12 at the lower forward corners. Torsion spring 16 is connected to the lower portion of lower extended arm 18 to provide stored mechanical energy to lift step stool 12 to the retracted position.

Figure 10:
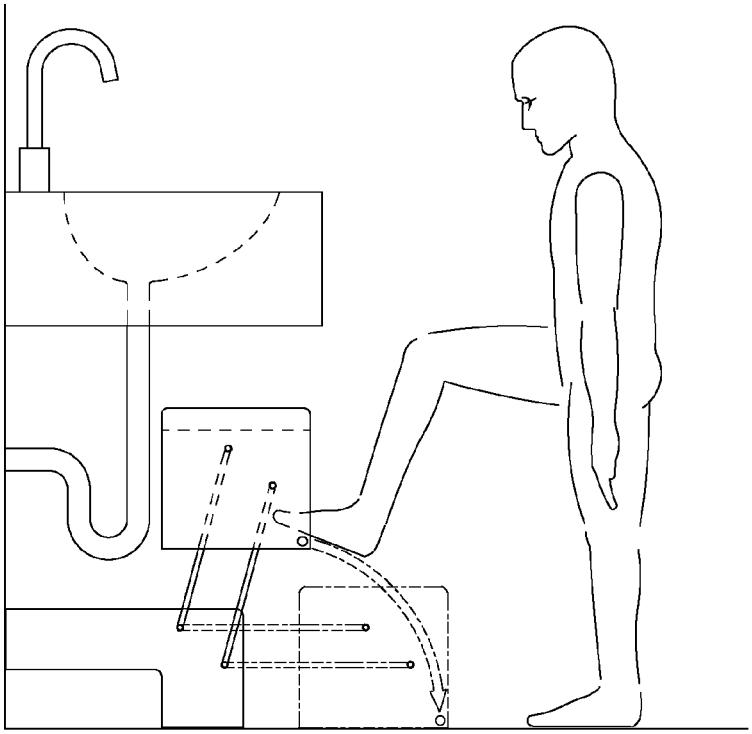
FIG. 10 is a side elevation view showing a small person deploying/re-storing version 3-4 of the step stool/access device.

As depicted in FIG. 10, a child can place a foot over bar 20 and press downward to move the stepstool to the floor F. The stepstool 12 retracts to the stowed position due to the energy stored in the torsion spring 16.

Figure 7:
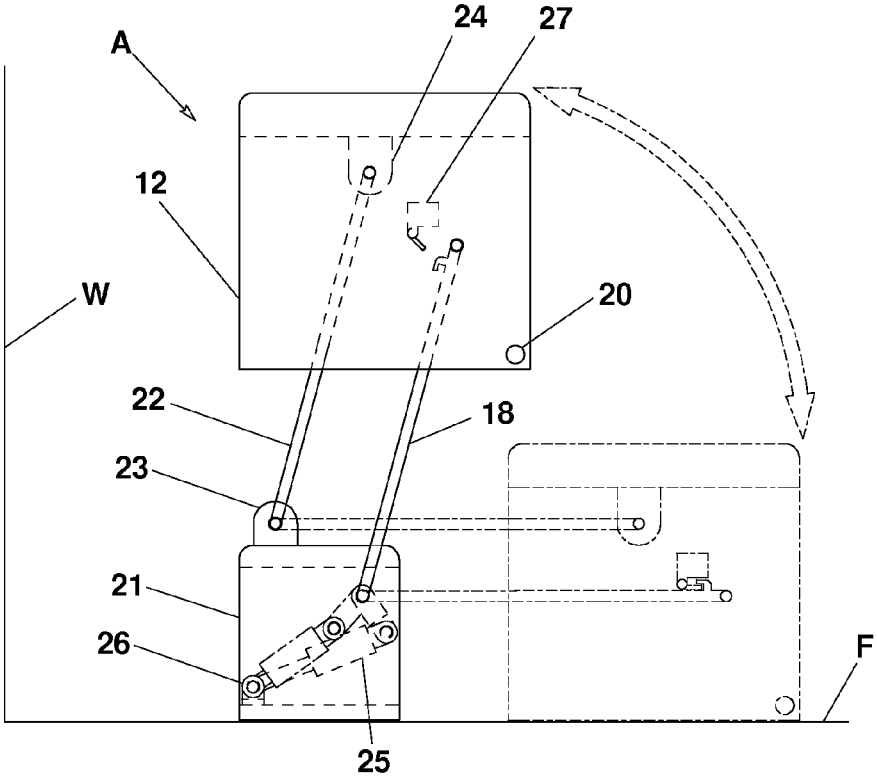
FIG. 7 is a right side elevation view of version 4 mounted to the floor showing the retractable step stool/access device in a raised stored position.
Figure 8:
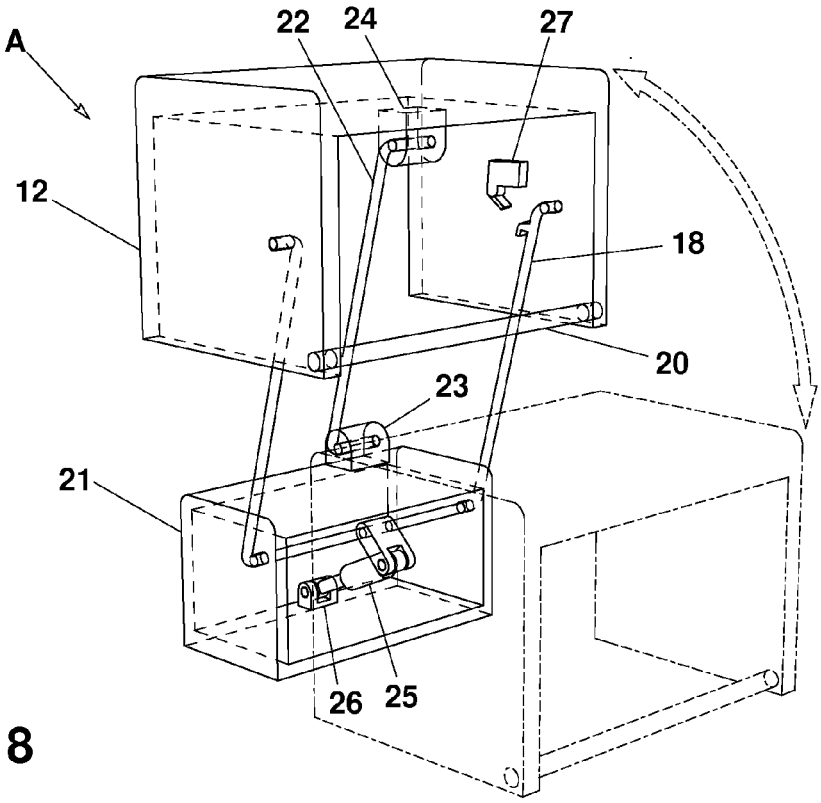
FIG. 8 is a perspective view of version 4 mounted to the floor showing the retractable step stool/access device in a raised stored position.

FIGS. 7 and 8 illustrate a fourth version of the invention. In this version the retractable step stool/access device assembly A is comprised generally of a step stool 12 and a floor mount base 21. The floor mount base 21 is mounted to the floor F. Step stool 12 is pivotally attached to floor base 21 by lower extended arm 18 and upper singular extended arm 22. Lower extended arm 18 is generally U-shaped with the lower segment captured within and passing through holes located in the upper forward corners of the opposing right and left sides of the floor base 21. The upper ends of the extended arm 18 bend outward and are captured within holes located on the insides of the opposed right and left supporting sides of the step stool 12. The upper singular extended arm 22 is pivotally attached at one end to a lower bracket 23 which is attached to the floor base 21 at the rearward upper edge. The opposing end of the upper singular extended arm 22 is pivotally attached to an upper bracket 24 which is attached to the underside of the top step platform of step stool 12. A gas spring 25 is pivotally attached to the lower portion of the lower extended arm 18 and to a central bracket 26 which is connected at the lower inside surface to floor base 21. Mechanical energy stored within gas spring 25 is utilized to lift the step stool 12 to a retracted or stowed position. Additionally, a latch mechanism 27 may be utilized in conjunction with the gas spring 25 that would engage when the step stool 12 is pressed to the floor allowing a child to step up onto the step stool 12 without having to continue to press it to the floor. Upon stepping up onto the step stool 12, the latch 27 would disengage so that when the child stepped off of the step stool 12, the mechanical energy of the gas spring would retract the stepstool 12 to a stowed position.

What is claimed is:

1. A retractable step stool assembly for assisting a person in elevating him or herself above a floor, the step stool assembly comprising:

a base member configured to directly rest on a cabinet floor elevated above the floor;

a step stool member in an upright position, the step stool member comprising a generally horizontal platform surface having two side members depending downwardly from opposite ends of the platform surface;

an arm assembly pivotally connecting the step stool member to the base member, the arm assembly configured to swing the step stool member between a stored position, in which the step stool member is positioned directly over a substantial portion of the base member as bottom surfaces of the side members directly rest on the cabinet floor, and a deployed position, in which the bottom surfaces directly rest on the floor in front of the base member and the cabinet floor;

the step stool member being self-supporting in its upright position in both the stored and the deployed positions;

wherein the arm assembly is configured to swing the step stool member such that the platform surface remains generally horizontal while moving the step stool member between the stored position and the deployed position; and wherein the step stool member comprises a foot-engaging member which is located below the platform surface and between the side members, the foot-engaging member comprising a downwardly directed surface which extends parallel to the platform surface and is configured to be engaged by a top of a foot of the person to move the step stool member between the stored and deployed positions such that the person can move the step stool member from the stored position to the deployed position by engaging the foot-engaging member with only his or her foot and then step up on the platform surface to elevate him or herself above the floor.

2. The step stool assembly of claim 1, wherein the base member is configured to be mounted to the cabinet floor.

3. The step stool assembly of claim 1, wherein the arm assembly comprises at least first and second arm members which are pivotally connected between the base member and the step member and, when the step stool assembly is viewed in profile with the step stool member in the deployed position, are spaced one above the other and are oriented generally parallel to each other.

4. The step stool assembly of claim 3, wherein the first arm member comprises a generally U-shaped configuration having a middle portion which is pivotally connected directly to the base member and two end portions which are pivotally connected to opposite sides of the step stool member.

5. The step stool assembly of claim 4, wherein the second arm member comprises a generally S-shaped configuration having a middle portion which is pivotally connected to the base member and two end portions which are pivotally connected to the opposite sides of the step stool member.

6. The step stool assembly of claim 4, wherein the second arm member comprises a first end which is pivotally connected to the base member and a second end which is pivotally connected to the step stool member.

7. The step stool assembly of claim 3, wherein when the step stool member is in the stored position the arm members are oriented at an angle of greater than 90° relative to a portion of the floor located forward of the base member.

8. The step stool assembly of claim 7, wherein the foot-engaging member is configured to transfer at least an initial upwardly and forwardly directed force from the person's foot into movement of the step stool member from the stored position toward the deployed position.

9. The step stool assembly of claim 8, wherein the foot-engaging member comprises a lip which depends downwardly from a forward edge of the platform surface.

10. The step stool assembly of claim 8, wherein the base member comprises a tray for storage of items, said tray comprising an upstanding back wall connected between two upstanding, spaced apart side walls.

11. The step stool assembly of claim 10, wherein each side member is positioned adjacent a respective side wall of said spaced apart side walls when the step stool member is in the stored position.

12. The step stool assembly of claim 11, wherein the first arm member comprises a generally U-shaped configuration having a middle portion which is pivotally connected directly to the base member and two end portions which are pivotally connected to corresponding ones of the side members.

13. The step stool assembly of claim 12, wherein the second arm member comprises a first end which is pivotally connected to one of the side walls and a second end which is pivotally connected to an adjacent side member of said side members.

14. The step stool assembly of claim 12, wherein the base member comprises an upstanding divider wall which is positioned parallel to and between the side walls, and wherein the second arm member comprises a first end which is pivotally connected to the divider wall and a second end which is pivotally connected to a portion of the step stool member located between the side members.

15. The step stool assembly of claim 14, further comprising a torsion spring which is connected between one of the first and second arm members and one of the base member and the step stool member and is configured to generate a force on the step stool member which assists the person in moving the step stool member from the deployed position to the stored position.

16. The step stool assembly of claim 1, wherein the base member comprises an upstanding back wall which extends between side walls to thereby define a tray for storage of items.

17. The step stool assembly of claim 16, wherein the step stool member is configured such that the tray is accessible when the step stool member is in the stored position.

* * * * *